US005513775A

United States Patent [19]

Sizemore

[11] Patent Number: 5,513,775

[45] Date of Patent: May 7, 1996

[54] SIDE MOUNTED CURRENCY/CARD OPERATED DISPENSER SYSTEM

[76] Inventor: Sean S. Sizemore, 1509 Salem Lake Rd., Winston-Salem, N.C. 27107

[21] Appl. No.: 234,814

[22] Filed: Apr. 28, 1994

[51] Int. Cl.[6] ..... B67D 5/10

[52] U.S. Cl. ..... 222/2; 222/173

[58] Field of Search ..... 222/2, 129.1, 52, 222/641, 173; 194/350; 235/381; 221/282; 312/198

[56] References Cited

U.S. PATENT DOCUMENTS

| | | | |
|---|---|---|---|
| 3,247,940 | 4/1966 | Christine et al. | 222/2 |
| 3,297,123 | 1/1967 | Hutchins | 194/97 |
| 3,448,843 | 6/1969 | Mesh | 222/2 |
| 4,651,862 | 3/1987 | Greenfield, Jr. | 222/2 |
| 4,821,862 | 4/1989 | Nelson | 194/241 |
| 5,291,004 | 3/1994 | Frank et al. | 222/2 |
| 5,344,046 | 9/1994 | Maldanis et al. | 222/2 |

*Primary Examiner*—Andres Kashnikow
*Assistant Examiner*—Philippe Derakshani
*Attorney, Agent, or Firm*—Rhodes, Coats & Bennett

[57] ABSTRACT

A dispenser controller is connected to an existing conventional fountain dispenser to form a unitary currency/card operated dispenser system. The dispenser system includes a support element which supports the dispenser controller and separably attaches the same to the fountain dispenser. The support element includes a platform having a first side and a second side. The first side is disposed beneath and connected to the dispenser with the second side extending outwardly therefrom forming a support shelf. The support element further includes one or more apertures formed in the first side for receiving one or more legs of the fountain dispenser. The support element may further include one or more support legs provided at the second side. A dispenser controller cabinet is mounted on protruding shelf formed by the support element's second side.

15 Claims, 2 Drawing Sheets

SIDE MOUNTED CURRENCY/CARD OPERATED DISPENSER SYSTEM

FIELD OF THE INVENTION

The present invention relates to coin and/or card operated liquid dispensers and, more particularly, to an integrally mounted, coin/card mechanism and controller system for dispensers which may be fixedly mounted and even retrofitted adjacent a conventional dispenser to form a unitary coin responsive dispenser assembly.

BACKGROUND OF THE INVENTION

Valve actuated drink dispensers or fountains are used in a variety of applications. Fast food, cafeteria and self-service restaurants and vending stations often provide a fountain dispenser which may be controlled by the customer. These fountain dispensers may be mechanically cooled or ice cooled. Typically, the fountain dispenser includes a nozzle and an actuation lever or button which activates an electrically operated valve. The user simply places his/her cup under the nozzle and actuates the button or lever to receive drink.

Of course, it is not always desirable to allow the customer complete control over the dispensing process. In retail environments where the fountain dispenser is not monitored, there exists the danger that the customer will take drink without paying or will take more drink than paid for. Therefore, there often exists a need for auxiliary control of the dispenser valve to limit the amount of drink which may be dispensed.

To this end, currency or card operated dispensing systems have been developed. These dispensing systems dispense a pre-determined amount of drink responsive to a given signal after a card or coin is deposit by the user. Such dispenser systems have several drawbacks. They are very expensive, generally costing on the order of six thousand dollars ($6,000) wholesale. Because they are typically constructed such that the coin operated valve controller is built into the cooler cabinet which contains or supports the dispensing components, these control systems cannot be retrofitted to conventional fountain dispensers as described above.

Thus, there exists a need for a currency/card dispenser control system which may be conveniently and cost effectively added to existing conventional fountain dispensers. Further, there exists a need for such a dispenser control system having a dispenser controller which is separate but easily attachable to the fountain dispenser. There exists a need for such a dispenser control system which may be securely fixed adjacent to the conventional dispenser equipment.

SUMMARY OF THE INVENTION

The present invention is directed to a side mounted currency/card operated dispenser system for use with a conventional fountain dispenser. The dispenser system of the present invention includes a dispenser controller and a support element which supports the dispenser controller and separably attaches the same to the fountain dispenser. When the dispenser system is mounted on the fountain dispenser, a unitary and integral controlled dispenser assembly is formed.

Typically, a conventional fountain dispenser cabinet has a plurality of control valves and is supported by detachable legs which depend therefrom. Each leg has a foot and an upwardly extending shank. The foot has a diameter greater than that of the shank. The shank is normally threaded and extends through the bottom of the dispenser cabinet where it is secured by a nut.

The aforementioned support element of the present invention is detachably secured to the dispenser and includes a platform. The platform has an upper surface, a lower surface, a first side and a second side. The first side is disposed beneath the dispenser and is fixed thereto by the two existing legs beneath the adjacent side of the dispenser cabinet. The second side protrudes outwardly from the cabinet a distance sufficient to support the currency/card controller cabin, which is secured thereto. One or more separate legs, similar to the others is placed beneath the support platform near the outer edge to support the weight of the currency/card cabinet.

The currency/card activated controller serves to control the dispenser. The controller includes its own cabinet secured to the upper surface of the support element. The controller also includes a currency/card input panel which is integral with the cabinet and adapted to receive currency such as coins or bills and cards. The control means within the cabinet is conventional and includes such components as to effect making change, validating credit cards and generating electronic signals sent to the dispenser to activate liquid release valves. The above functions are generally effected electronically. An output means such as an electrical cable is interconnected between the controller and the control valve of the dispenser and serves to actuate and deactuate the control valve in response to the control means.

In one embodiment, an aperture is formed in the second side of the platform and a support leg is provided to support the dispenser controller. The support leg includes a shank having a diameter less than that of the aperture and a foot having a diameter greater than that of the aperture. The foot is disposed below the lower surface of the platform and the shank extends upwardly through the aperture.

It is an object of the present invention to provide an improved currency/card operated dispenser system for controlling the discharge of liquid from the dispenser.

It is a further object of the present invention to provide such a system for controlling the dispenser which may be cost effectively retrofitted or added-on to existing fountain-type dispensers.

It is yet another object of the present invention to provide a system as described above which may be separably attached to a dispenser.

It is yet another object of the-present invention to provide a system for controlling a dispenser having a dispenser controller which is commonly supported with the dispenser by means of a separably attachable support element, thereby forming a unitary controlled dispenser assembly.

DETAILED DESCRIPTION OF THE INVENTION

Figure 1:
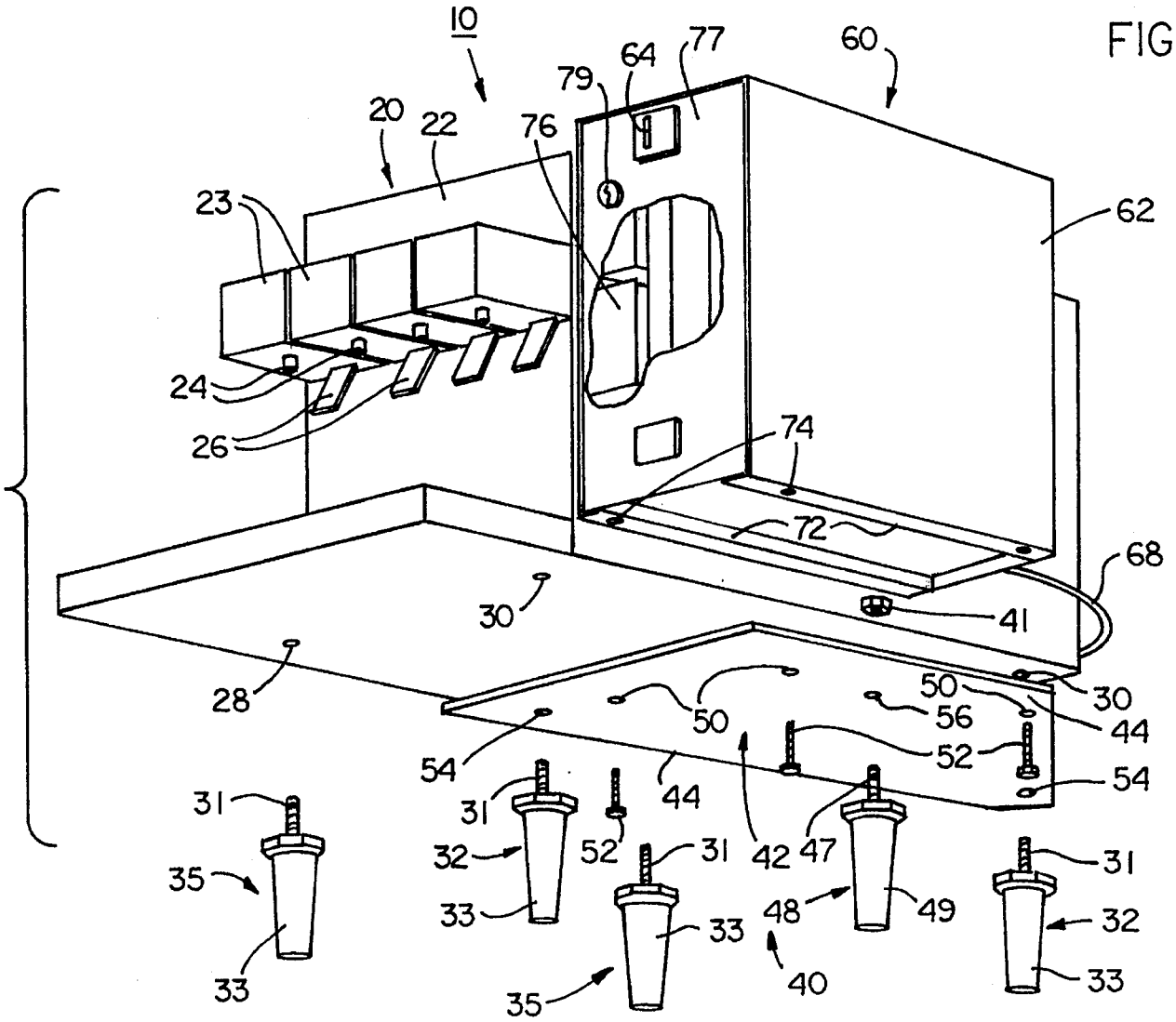
FIG. 1 is an exploded perspective view from below of a dispenser control system according to the present invention shown in conjunction with a conventional dispenser.

In the following description, like reference characters designate like or corresponding parts throughout the several views. Also in the following description, it is to be understood that such terms as "forward," "rearward," "left," "right" "upwardly" "downwardly," "upper," "lower," "first," "second," and the like are words of convenience and are not be construed as limiting terms. While the term "coin operated" is sometimes used herein, it should be realized that this should be interpreted to include other currency and credit cards.

As best seen in FIG. 1, currency/card operated dispenser system according to the present invention is generally denoted by the numeral 10. System 10 a fountain dispenser 20, comprises support element 40 and dispenser controller 60. Fountain dispenser 20 is conventional.

Conventional fountain dispenser 20 includes dispenser cabinet 22, nozzles 24, flow control valve 23, mechanical valve levers 26, and dispenser support legs 32, 35. Legs 32, 35 include feet 33, and externally threaded shanks 31 secured thereto. Cabinet 22 has internally threaded apertures 30 and 28 adapted to threadedly engage the shanks of legs 32 and 35, respectively. Alternatively, apertures 30, 28 may be unthreaded and bolts (not shown) may be provided to secure the shanks.

Support element 40 includes platform 42 and an additional leg 48. Leg 48 is similar to legs 32, 35 and includes threaded shank 47 secured to foot 49. Platform 42 has first side 44 and second side 46. First apertures 54 are formed in first side 44 and sized to receive shanks 31 of legs 32. Second aperture 56 is formed in second side 46 and sized to receive shank 47 of leg 48.

Dispenser controller 60 includes cabinet 62 and control means 76. Currency/card input panel 64 is placed in the front wall or door 77 of controller 60 and communicates with the control means. Output means such as an electrical cable 68 also communicates with control means 76 and extends from cabinet 62 through cabinet 22 and to valves 23. Control means 76 includes a timing circuit responsive to currency to release a prescribed volume of liquid. But any suitable control mechanism may be used as a control means. The term "currency" as used herein means coins, tokens, bills, magnetic strip cards, hole-punched cards or the like. When a selected amount of currency is deposited in currency input 64, control means 76 via output means 68 causes valves 23 to dispense drink or other product for a set period of time.

Cabinet 62 includes door 77 for accessing control means 76 and lock 79 for securing the same. Lips 72 extend inwardly from the lower edges of the side walls of cabinet 62. Screw holes 74 are formed in lips 72 and are adapted to engage screws 52.

Dispenser controller 60 may be mounted on dispenser 20 as follows. Legs 32 are unscrewed from apertures 30. Support platform 42 is then interfaced with the bottom panel of cabinet 22 such that apertures 54 align with apertures 30. Shanks 31 are reinserted through apertures 54 and screwed into threaded apertures 30. Because feet 33 have a diameter greater than that of apertures 54, platform 42 is now secured to cabinet 22. It will be appreciated that dispenser 20 is now supported by four fleet 33. The feet of legs 32 may be reduced to accommodate the thickness of platform 42 so that cabinet 22 will remain level.

Controller cabinet 62 is placed on the upper surface and second side 46 of platform 42 such that apertures 50 and screw holes 74 are aligned. Cabinet 62 is then secured to platform 42 by screws 52. Shank 47 is inserted through aperture 56 and secured to platform 42 by bolt 41. Electrical cable 68 is inter-connected between cabinet 62 and valves 23.

Platform 42 may be secured to controller cabinet 62 prior to or after being secured to dispenser cabinet 22. Furthermore, dispenser controller 60 may be formed integrally with or permanently secured to platform 42. Alternatively, cabinet 62 may be provided with a bottom panel having an aperture formed therein so that cabinet 62 is secured to platform 42 by leg 48 in addition to or instead of screws 52.

Figure 3:
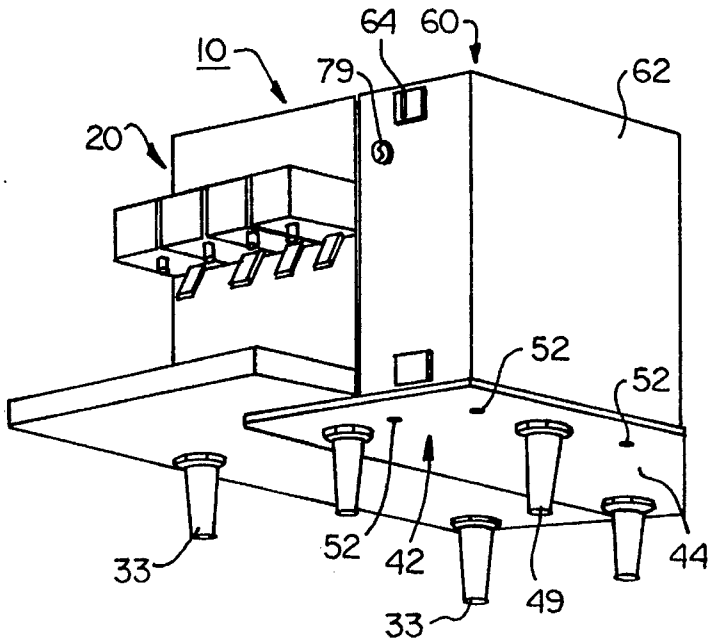
FIG. 3 is a perspective view from below of a dispenser control system of the present invention shown mounted on a conventional fountain dispenser.
Figure 2:
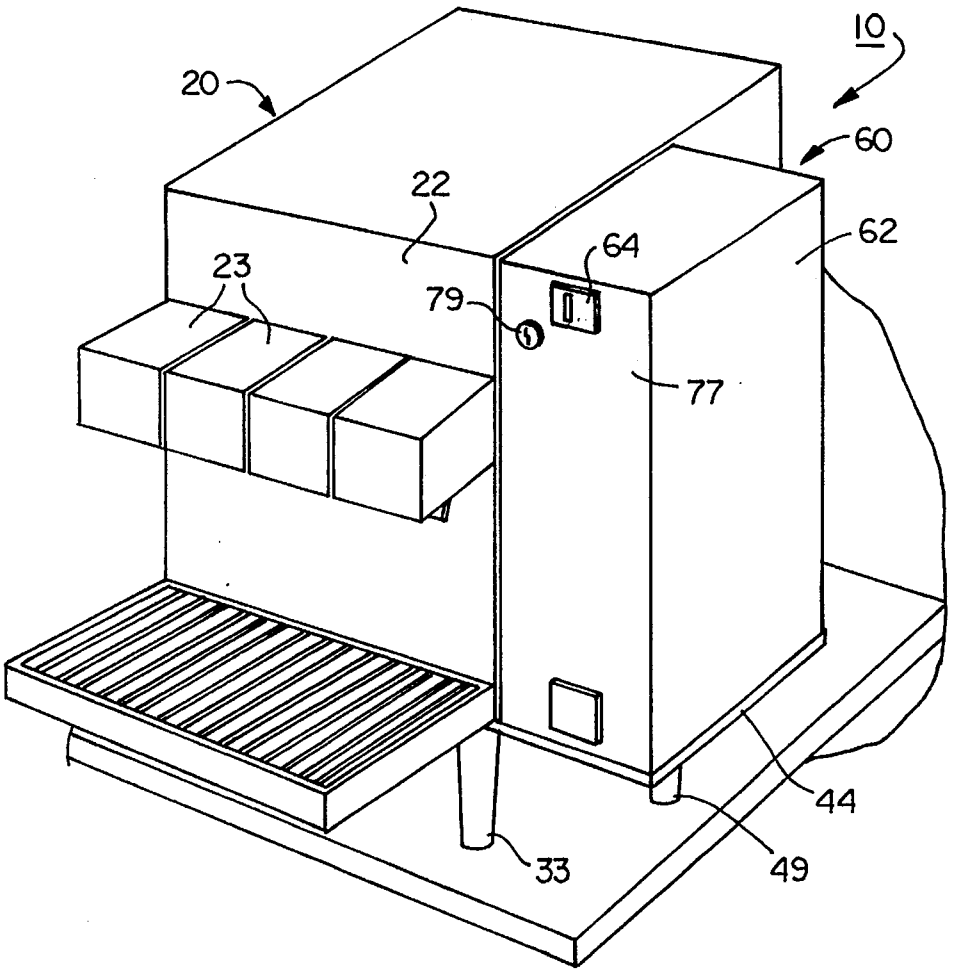
FIG. 2 is a top perspective view of a dispenser control system of the present invention shown mounted on a conventional fountain dispenser, the unitary controlled dispenser assembly supported by a table.

FIGS. 2 and 3 show dispenser control system 10 mounted on dispenser 20. The resultant unitary assembly is supported by legs 35, 32, 48.

Certain modifications and improvements will occur to those skilled in the art upon reading the foregoing description. By way of example, the platform may be secured to the dispenser by means of rivets, clips, bolts, or screws. It should be understood that all such modifications and improvements have been deleted herein for the sake of conciseness and readability but are properly within the scope of the following claims.

What is claimed is:

1. A currency/card operated dispenser system having a dispenser and dispenser controller, the dispenser having a control valve and supported by a plurality of detachable legs depending therefrom, each of said legs having a shank and a foot having a diameter greater than that of the shank, said dispenser system further comprising:

a support element detachably secured to the underside of said dispenser and comprising:

a) a platform having an upper surface, a lower surface, a first side and a second side, said first side disposed beneath at least a portion of the dispenser, said second side extending outwardly from the dispenser; and b) at least one support leg placed beneath said second side;

a dispenser controller cabinet having control means therein secured to said upper surface of said support element; and a currency input integral with said dispenser controller cabinet and adapted to receive currency and activate said control means responsive thereto.

2. The dispenser system of claim 1 wherein said dispenser controller cabinet is detachably secured to said support element.

3. The dispenser system of claim 1 wherein said control means is responsive to currency inserted into said currency input and further including an output means interconnected between said control means and the control valve of the dispenser and operable to actuate and deactuate the control valve.

4. The dispenser system of claim 1 wherein said at least one support leg of said support element extends downwardly from said lower surface.

5. The dispenser system of claim 4 further including an aperture formed in said second side, wherein said at least one support leg includes a shank having a diameter less than that of said aperture and a foot having a diameter greater than that of said aperture, said foot disposed below said lower surface, said shank extending upwardly through said aperture.

6. A support element for affixing and supporting a dispenser controller cabinet adjacent a dispenser, said dispenser being of the type supported by a plurality of detachable legs depending therefrom, each of said legs having a shank and a foot, the foot having a diameter greater than that of the shank, said support element comprising:

a platform having an upper surface, a lower surface, a first side and a second side, said first side disposed beneath and affixed to the dispenser, said second side extending outwardly beyond the side of the dispenser, said dispenser controller cabinet being mounted on said second side of said platform, and attachment means for fixing said platform to the dispenser.

7. The-support element of claim 6 further including a support leg located beneath said second side and extending downwardly from said lower surface.

8. The support element of claim 7 wherein the dispenser is detachably secured to said support element.

9. The support element of claim 8 wherein said attachment means includes a plurality of apertures formed in said first side and having a diameter greater than the diameter of the shank of the dispenser leg and less than the diameter of the dispenser foot, said first side being fixed to said dispenser by means of said detachable legs along the adjacent side of said dispenser cabinet.

10. The support element of claim 9 further including at least one second aperture formed in said second side, and wherein said support leg includes a shank having a diameter less than that of said second aperture and a foot having a diameter greater than that of said second aperture, and wherein said support leg is fixed to said support element by means of a portion of said shank extending upwardly through said second aperture.

11. A dispenser control system for use with a dispenser cabinet having a control valve, comprising:

a) a support element detachably coupled to the dispenser cabinet; and b) a dispenser controller cabinet coupled to said support element and adapted to receive a dispenser control means.

12. The dispenser control system of claim 11 wherein said dispenser controller cabinet is integrally formed with said support element.

13. The dispenser control system of claim 11 wherein said dispenser controller cabinet is detachably secured to said support element.

14. The dispenser control system of claim 11 further including a support leg depending from said support element below said dispenser controller cabinet.

15. The dispenser control system of claim 11 further including:

a currency input integral with said dispenser controller cabinet and adapted to receive currency;

a control means disposed within said dispenser controller cabinet and responsive to currency inserted into said currency input; and an output means interconnected between said control means and the control valve of the dispenser and operable to actuate and deactuate the control valve.

* * * * *